US011365937B2

(12) United States Patent
Foerster et al.

(10) Patent No.: US 11,365,937 B2
(45) Date of Patent: Jun. 21, 2022

(54) COLLECTOR TUBE FOR A HEAT EXCHANGER

(71) Applicant: Mahle International GmbH, Stuttgart (DE)

(72) Inventors: Uwe Foerster, Erdmannhausen (DE); Martin Kaspar, Fellbach (DE); Hicham Rouhana, Korntal-Munchingen (DE); Markus Wawzyniak, Ludwigsberg (DE)

(73) Assignee: Mahle International GmbH

( * ) Notice: Subject to any disclaimer, the term of this patent is extended or adjusted under 35 U.S.C. 154(b) by 208 days.

(21) Appl. No.: 16/693,017

(22) Filed: Nov. 22, 2019

(65) Prior Publication Data

US 2020/0166277 A1 May 28, 2020

(30) Foreign Application Priority Data

Nov. 23, 2018 (DE) ..... 10 2018 220 139.0

(51) Int. Cl.
*F28F 9/02* (2006.01)
*F28D 1/03* (2006.01)
(Continued)

(52) U.S. Cl.
CPC ..... *F28D 1/0391* (2013.01); *F28F 9/182* (2013.01); *F28D 1/05366* (2013.01);
(Continued)

(58) Field of Classification Search
CPC ..... F28D 1/0391; F28D 1/05366; F28D 2021/0073; F28D 2021/0084;
(Continued)

(56) References Cited

U.S. PATENT DOCUMENTS 5,107,926 A 4/1992 Calleson
6,145,589 A * 11/2000 Gowan ..... F28F 9/16 165/173
(Continued)

FOREIGN PATENT DOCUMENTS

DE 41 30 517 A1 3/1993
DE 10 2007 016 050 A1 10/2007
(Continued)

OTHER PUBLICATIONS

English abstract for FR-2 952 711.
(Continued)

*Primary Examiner* — Claire E Rojohn, III
(74) *Attorney, Agent, or Firm* — Fishman Stewart PLLC

(57) ABSTRACT

A collector tube for a heat exchanger having at least one flat tube, may include a base and a cover arranged opposite the base. The base and the cover may define a longitudinal duct. The base may include at least one passage having an opening configured to accommodate the at least one flat tube of the heat exchanger. The opening may have at least one wide edge and at least one narrow edge. The longitudinal duct may have, in a cross section, a diameter that is smaller than the at least one wide edge of the opening. The at least one passage may include a collar extending away from the longitudinal duct.

20 Claims, 3 Drawing Sheets

(51) Int. Cl.
*F28F 9/18* (2006.01)
*F28D 21/00* (2006.01)
*F28D 1/053* (2006.01)

(52) U.S. Cl.
CPC ..... *F28D 2021/0073* (2013.01); *F28D 2021/0084* (2013.01); *F28D 2021/0094* (2013.01); *F28F 9/0224* (2013.01); *F28F 9/0243* (2013.01)

(58) Field of Classification Search
CPC . F28D 2021/0094; F28F 9/182; F28F 9/0224; F28F 9/0243
USPC ..... 165/173
See application file for complete search history.

(56) References Cited

U.S. PATENT DOCUMENTS 6,289,980 B1 * 9/2001 Insalaco ..... F28F 9/0243 165/174
8,439,104 B2 * 5/2013 de la Cruz ..... F28D 1/05391 165/173
9,097,469 B2 * 8/2015 Foerster ..... F28D 1/05366
9,523,540 B2 * 12/2016 Hirayama ..... F28D 1/05391
9,546,828 B2 * 1/2017 Moreau ..... F28F 9/00
11,029,101 B2 * 6/2021 Armsden ..... F28D 7/0066
2005/0039900 A1 * 2/2005 Yu ..... F28F 9/02 165/173
2007/0074860 A1 * 4/2007 Shinhama ..... F28F 9/0212 165/173
2007/0119580 A1 * 5/2007 Wawzyniak ..... F28F 9/04 165/173
2010/0038063 A1 * 2/2010 Saumweber ..... F28F 9/182 165/173
2012/0298344 A1 * 11/2012 Mcdonnell ..... F28F 9/02 165/173
2015/0354900 A1 * 12/2015 Duerr ..... F28D 1/05391 165/166
2016/0282062 A1 * 9/2016 Girmscheid ..... F28F 1/025
2016/0356532 A1 * 12/2016 Wijaya ..... F28F 9/0204
2017/0328637 A1 * 11/2017 Parola ..... F28D 1/0443
2017/0328652 A1 * 11/2017 Matsui ..... F28D 1/05366
2018/0363987 A1 * 12/2018 Itou ..... F28D 1/0461
2020/0018528 A1 * 1/2020 Akaiwa ..... F28F 9/0278
2020/0166277 A1 * 5/2020 Foerster ..... F28F 9/182
2020/0166294 A1 * 5/2020 Dolderer ..... F28F 9/0212

FOREIGN PATENT DOCUMENTS

DE 10 2006 053 702 A1 5/2008
DE 10 2009 023 954 A1 12/2010
DE 10 2013 205 763 A1 10/2013
EP 1 347 259 A1 9/2003
EP 2 097 707 A1 9/2009
EP 2 648 862 A1 10/2013
FR 2 952 711 A1 5/2011
JP H08-334 292 A 12/1996
JP 2004-211 925 A 7/2004
WO 2014/131 756 A1 9/2014
WO 2015/079 653 A1 6/2015
WO 2015/086 195 A1 6/2015

OTHER PUBLICATIONS

English abstract for DE-10 2006 053 702.
English abstract for JP-2004-211 925.
English abstract for JP-H08-334 292.
English abstract for DE-41 30 517.
English abstract for DE-10 2007 016 050.

* cited by examiner

COLLECTOR TUBE FOR A HEAT EXCHANGER

CROSS-REFERENCE TO RELATED APPLICATIONS

This application claims priority to German Patent Application No. DE 10 2018 220 139.0, filed on Nov. 23, 2018, the contents of which are hereby incorporated by reference in their entirety.

TECHNICAL FIELD

The present invention relates to a heat exchanger for a vehicle as well as to a collector tube for such a heat exchanger.

BACKGROUND

In vehicles, heat exchangers and in particular condensers are used, for example, as part of an air conditioning circuit for regulating the room temperature in the vehicle interior. The heat exchanger or condenser, respectively, has a plurality of flat tubes, which are spaced apart from one another and which are fluidically connected to one another by means of at least one collector tube. A gaseous refrigerant, which was compressed by a compressor of the air conditioning circuit, initially flows into the collector tube through an inlet and subsequently through the flat tubes. While the refrigerant flows through the flat tubes, it dissipates its heat energy to the flat tubes or to the surrounding area of the flat tubes, respectively, so that it cools down and condenses. The condensed or liquid refrigerant, respectively, is supplied to the air conditioning circuit again via an outlet.

A collector tube for heat exchangers or condensers, respectively, is typically embodied as round tube, which has an essentially round cross section. The collector tube has openings, into which flat tubes comprising a specified width are inserted. The flat tubes thereby partially protrude into the longitudinal duct and thus reduce the usable diameter of the longitudinal duct. So that a fluid, such as a refrigerant, does not experience too large of a flow resistance due to the protruding flat tubes, the longitudinal duct of the round tube has a diameter, which is equal to or larger than the width of the flat tubes.

The openings can be punched or can also be embodied in combination with a passage. During the production of the heat exchanger or condenser, respectively, the flat tubes are soldered to the collector tube, in order to establish a fluid-tight and mechanically stable connection. Passages are advantageous thereby, because the surfaces, which are to be soldered, of the respective flat tube and of the collector tube are increased and a more stable solder connection can thus be established.

Passages, which protrude into the collector tube, belong to the known prior art. A collector tube is also known from EP 2 097 707 B1, in the case of which the passages extend away from the collector tube. The flat tubes, which are embodied as micro duct flat tubes, thereby protrude into the collector tube, in order to prevent clogging of the micro ducts of the flat tubes by the soldering material.

It is a disadvantage of these collector tubes that pocket areas form in the longitudinal duct between the protruding flat tubes and/or passages, which pocket areas are filled with refrigerant, but which do not contribute to the function of the heat exchanger or condenser, respectively, because the refrigerant accumulates in these pocket areas and cannot flow in the longitudinal direction of the longitudinal duct. This leads to an increased flow resistance along the longitudinal duct and to an increased dead weight of the heat exchanger or condenser, respectively, because unnecessary refrigerant has to be filled in.

To decrease these pocket areas, FR 2 952 711 A1 and EP 2 648 862 B1 proposes that the collector tube is made up of two components. The first component is a base, which has at least one opening for a flat tube, the second component is a cover. The base and the cover are joined together, wherein the two components are connect to one another in a fluid-tight manner during the production, so as to embody a longitudinal duct. This longitudinal duct does not have a round cross section, but a semi-circular cross section comprising an arch area and a base area, wherein the cross section of the base area has a larger curvature radius than the arch area.

The base area is embodied essentially by means of a subarea of the base, wherein this subarea is essentially flat. The arch area is embodied essentially by a subarea of the cover. The length of the base area and thus the diameter of the longitudinal duct essentially corresponds to the width of the flat tubes. Passages are proposed in FR 2 952 711 A1 and in EP 2 648 862 B1, which protrude into the longitudinal duct, so that even through pocket areas also form in the case of these solution, they have a smaller available space than the pocket areas, which are created in the case of one-piece round tubes, due to the base area, which is embodied to be flat. The required amount of refrigerant as well as the dead weight of the heat exchanger or condenser, respectively, is thus reduced.

To further reduce the amount of the required refrigerant, DE 10 2009 023 954 A1 proposes a collector tube, which is made up of an essentially flat base and a cover, so that a longitudinal duct comprising a semi-circular cross section forms. However, the diameter of the longitudinal duct is thereby smaller than the width of the flat tubes, which are inserted into the base. In the case of such a diameter, passages protruding into the longitudinal duct cannot be used, because the flow resistance along the longitudinal duct would become so large that the function of the heat exchanger of condenser, respectively, would be adversely affected. DE 10 2009 023 954 A1 thus provides that the openings are punched in the base and do not have a collar. During the production of the heat exchanger or condenser, respectively, only surfaces, which essentially correspond to the product of circumference of the respective opening and the material thickness of the base, are thus available for soldering. CO2 gas coolers have a material thickness of, for example, approx. 2.5 mm, whereby, in contrast, condensers for conventional refrigerants offer a material thickness of approximately 1 mm.

Due to the punching process, the soldering material can further not be introduced between the respective flat tube and the opening as solder plating prior to the soldering process, but has to flow into a gap between the flat tube and the opening during the soldering process. The flow of the soldering material is thereby obstructed by the punching edge.

SUMMARY

The present invention is based on the object of further developing the collector tubes of the latter type in such a way that they provide more stable solder connections as well as a simpler production of the heat exchanger or condenser, respectively.

This problem is solved according to the invention by means of the subject matter of the independent claim(s). Advantageous embodiments are subject matter of the dependent claim(s).

The present invention is based on the general idea that the base of the collector tube has passages, which extend away from the longitudinal duct.

The collector tube according to the invention can be used in a heat exchanger or condenser, respectively, wherein the heat exchanger or condenser, respectively, has at least one flat tube. A heat exchanger or condenser, respectively, typically has a plurality of flat tubes, which are arranged spaced apart from one another. Fins can be provided between these flat tubes so as to improve the stability of the heat exchanger or condenser, respectively, and so as to improve enlarge the surface, over which a heat exchange with the external environment of the heat exchanger or condenser, respectively, can take place.

The flat tube limits at least one available space or a duct, respectively, from the external environment, through which the refrigerant can flow, in order to condense, for example. This flat tube has at least two front sides, the distance of which defines the length of the flat tube. The flat tube has an essentially rectangular cross section, which comprises a wide length as well as a narrow length. The production method of the flat tube can be embodied arbitrarily thereby.

The collector tube is embodied at least in two parts, wherein the first component is a base and the second component is a cover. The base and the cover are arranged so as to be located opposite one another and embody a longitudinal duct.

The base can have an outer base surface and an inner base surface. The outer base surface is defined as the surface of the base, which is in contact with the external environment in the case of the assembled collector tube. The remaining surface of the base, which is not in contact with the external environment in the case of the assembled collector tube, is defined as inner base surface.

The cover can have an outer cover surface and an inner cover surface. The outer cover surface is defined as the surface of the cover, which is in contact with the external environment in the case of the assembled collector tube. The remaining surface of the cover, which is not in contact with the external environment in the case of the assembled collector tube, is defined as inner cover surface.

The base and the cover can be assembled in such a way that the longitudinal duct is fluid-tight with respect to the external environment. For this purpose, the base can have at least one base collar. It can be provided that subareas of the inner base surface are in contact with subareas of the inner cover surface. The subarea of the inner base surface, which is not in direct contact with the inner cover surface, is defined as base area. The subarea of the inner cover surface, which is not in contact with the inner base surface, is defined as arch area.

The base area and the arch area can limit the longitudinal duct. The longitudinal duct can have an essentially semi-circular cross section, wherein the semi-circular contour can be formed by the arch area. The base area can be located opposite the semi-circular contour.

It can be provided that the base is embodied to be essentially flat. In this context, flat can be understood such that in the cross section of the longitudinal duct, the base area has at least one curvature radius, which is larger than the smallest curvature radius of the arch area. The arch area can thereby curve away from the base. The base area can curve away from the cover and/or towards the cover. A curvature of the cover can lead to an improved pressure stability.

The base has at least one passage comprising an opening for accommodating a flat tube of the heat exchanger, wherein the opening has at least one wide edge and at least one narrow edge. The opening can have a cross section, which is adapted to the flat tube, wherein the length of the wide edge and the length of the narrow edge corresponds at least to the wide length or narrow length, respectively, of the flat tube.

In the cross section, the longitudinal duct has a diameter, which is smaller than the length of a wide edge of the opening of the at least one passage. Smaller can be understood here such that the difference between the length of a wide edge of the opening and the diameter of the longitudinal duct is at least larger than twice the material thickness of the base and/or cover. The available space inside the heat exchanger or condenser, respectively, which has to be filled by the refrigerant, can thereby be reduced to a minimum. When using a comparatively expensive refrigerant, such as, for example, R1234yf, a reduction of the production or operating costs, respectively, of the heat exchanger can also be attained.

When looking at the cross section of the longitudinal duct, the diameter can essentially be defined as the shortest distance between the beginning and the end of the arch area. The beginning or the end, respectively, of the arch area can thereby essentially be present at the points where the inner base surface and the inner cover surface are in contact.

The passage has a collar, which extends away from the longitudinal duct, thus does not protrude into the longitudinal duct. The collar can be torn from the inside to the outside. The respective flat tube can be inserted through the opening and the collar of the passage, wherein the front edge can be flush with the base area.

Due to the collar, a larger surface is available during the production of the heat exchanger or condenser, respectively, which can be used to solder the base and the flat tube. The size of this surface is thus independent of the material thickness of the base. The mechanical stability of the produced heat exchanger or condenser, respectively, is thus improved.

It can be provided that the inner base surface of the base and/or the surface areas of the collar, which are used for soldering, are provided with a solder plating. This has the advantage that the solder material does not need to flow around the punching edge and the soldering process is thus improved.

In the case of a further advantageous embodiment of the solution according to the invention, it is provided that the opening of the passage tapers at least partially towards the longitudinal duct. By means of a counter-punching during the production of the collar of the passages, an insertion bevel for the flat tubes can thus be created, which simplifies the insertion of the flat tubes. It can also be provided that the opening of the passage initially tapers towards the longitudinal duct and then widens again. The narrowest point of such an opening is thereby dimensioned in such a way that an insertion of the flat tube is possible.

In the case of an advantageous further development of the solution according to the invention, it is provided that a second subarea of the opening, which widens towards the longitudinal duct, is provided between the first subarea of the opening and the longitudinal duct.

In the case of a further advantageous embodiment of the solution according to the invention, it is provided that the opening of the at least one passage embodies an insertion bevel above an outer base surface and a widening below the outer base surface. Above can be understood such that the insertion bevel extends away from the outer base surface and the longitudinal duct, thus is not arranged between outer base surface and longitudinal duct. Below can be understood such that the widening extends from the outer base surface to the longitudinal duct or is arranged between outer base surface and longitudinal duct, respectively.

In the case of an advantageous further development of the solution according to the invention, it is provided that the cover has at least one cover collar. In areas located opposite a passage of the base, this cover collar has at least one depression, which extends away from the longitudinal duct. Together with the inner base surface of the base, the depression of the cover collar embodies a transverse duct, which extends essentially transversely to the longitudinal direction of extension of the longitudinal duct. The depression initially prevents the flat tube from resting on the cover collar, which can lead to damages to the flat tube. In addition, the transverse duct guides the refrigerant, which flows through the edge areas of the flat tube, to the longitudinal duct of the collector tube.

In the case of a further advantageous embodiment of the solution according to the invention, it is provided that the base has at least two passages, which are spaced apart from one another, wherein at least one reinforcement bead is provided between the passage in the base. The reinforcement bead can have a curvature, which is embodied so as to point towards the longitudinal duct. It can also be provided that the reinforcement bead has a longitudinal extension, which is essentially parallel to the longitudinal extension of the longitudinal duct. This initially has the advantage that the pressure stability of the entire collector tube is increased.

It can also be provided that the reinforcement bead is arranged between the base area and the area, at which the inner base surface and the inner cover surface touch. Without such a reinforcing bead, a high tensile stress or peel stress, respectively, is created at the connecting seam between the inner base surface and the inner cover surface due to the internal pressure in the longitudinal duct. The use of the reinforcing bead leads to a reduction of this peel stress, because the reinforcing bead clings to the transition radius between longitudinal duct and cover collar in such a way that the peel stress is at least partially converted into a shear stress. This leads to an increased pressure stability of the collector tube.

In the case of an advantageous further development of the solution according to the invention, it is provided that at least one separating element is introduced between cover and base. The separating element has at least one separating wall and at least one holding arm. The cover and/or the cover collar is provided with at least one recess, into which the at least one holding arm of the separating element can be inserted. The recess can be embodied as slit. The separating element is used to segment the longitudinal duct and to create, for example, a meander-shaped flow guidance of the refrigerant through the flat tubes. The surface area of the separating wall can essentially correspond to the cross sectional surface of the longitudinal duct, wherein the shape of the separating wall is selected in such a way that a fluid-tight separation of two segments of the longitudinal duct is ensured. Due to the holder arm, which is inserted into the recess, the separating element is located in the cover in a non-tiltable and captive manner, until the base and the cover are brought together.

The separating element can also have two holder arms, wherein the cover and/or the cover collar is provided with at least two recesses in this case, into which the holding arms can be inserted.

In the case of a further advantageous embodiment of the solution according to the invention, it is provided that the base has an outer base surface, which is at least partially provided with a protective layer. This protective layer can be a plating of the outer base surface with an alloy, which has, for example, a higher corrosion resistance than the base material of the base. Such a protective plating cannot be used in the case of passages, which protrude into the longitudinal duct, because the protective plating is generally not suitable for soldering. The service life of the heat exchanger or condenser, respectively, is thus significantly improved with the use of passages, which extend away from the longitudinal duct, in combination with a protective layer. It can also be provided that the entire outer base surface of the base is provided with a protective plating. It can further be provided that at least a subarea or also the entire inner base surface is provided with a solder plating.

In the case of an advantageous further development of the solution according to the invention, it is provided that the longitudinal duct essentially has a semi-circular cross section comprising an arch area and a base area. The arch area is essentially formed by the cover, wherein a cover collar comprising a cover collar width in each case connects to the arch area on both sides. The base area is essentially formed by the base, wherein the base has a base collar comprising a predetermined material thickness. It is provided that the sum L of the cover collar width and the material thickness of the base collar with a predetermined base width B of the base lies in the range of between $$L_1 = \frac{(B - 11\text{ mm})}{2} - 1\text{ mm and } L_2 = \frac{(B - 11\text{ mm})}{2} + 1\text{ mm.}$$

The limits $L_1$ and $L_2$ represent an optimal range in the stress ratio of the following embodiment. In the case of a small L, the solder surface between cover collar and base is small, so that a longitudinal duct comprising a large diameter can be used. The stresses, which appear at the soldering between cover collar and base, are thus also large due to the operating pressure. On the other hand, the flow resistance for the refrigerant is small due to the larger diameter of the longitudinal duct. If, in contrast, L is enlarged, only a small diameter can be used for the longitudinal duct, so that the flow resistance for the refrigerant increases. On the other hand, however, the stresses, which appear at the soldering between cover collar and base, decrease.

If the base width B is specified with a lower and upper tolerance limit, the limit $L_1$ is calculated on the basis of the lower tolerance limit, and the limit $L_2$ on the basis of the upper tolerance limit. The following advantageous value pairs can be specified in an exemplary manner:

B=24-22 mm, L1=5 mm, L2=7 mm
B=22-20 mm, L1=4 mm, L2=6 mm
B=20-18 mm, L1=3 mm, L2=5 mm
B=18-16 mm, L1=2 mm, L2=4 mm
B=16-14 mm, L1=1 mm, L2=3 mm
B=14-12 mm, L1=0 mm, L2=2 mm

In the case of a further advantageous embodiment of the solution according to the invention, it is provided that the cover collars have different cover collar widths, which lead to different sums $L_A$ and $L_B$, wherein the average $(L_A+L_B)/2$ lies in the range of between $L_1$ and $L_2$.

The invention further relates to a heat exchanger, in particular a condenser for a vehicle, which is equipped with a plurality of flat tubes, which are spaced apart from one another. The flat tubes are thereby fluidically connected to one another by means of at least one collector tube according to the invention, which is described above. For example two collector tubes or also only one collector tube can be provided, wherein in the case of one collector tube, the flat tubes can have a U-shaped course. It can also be provided that a collector tube has an inlet and an outlet, which can be connected to an air conditioning circuit of a vehicle.

In the case of an advantageous further development of the solution according to the invention, it is provided that the base of the collector tube is embodied to be essentially flat, wherein the flat tubes are introduced into passages of the collector tube, wherein front edges of the flat tubes are essentially flush with the base. If the base provides for a curvature, the front edges of the flat tubes can also have a curved course, so as to attain a flush closure with the base and so as not to reduce the flow cross section of the longitudinal duct.

Further important features and advantages of the invention follow from the subclaims, from the drawings, and from the corresponding figure description on the basis of the drawings.

It goes without saying that the above-mentioned features and the features, which will be described below, cannot only be used in the respective specified combination, but also in other combinations or alone, without leaving the scope of the present invention.

Preferred exemplary embodiments of the invention are illustrated in the drawings and will be described in more detail in the below description, whereby identical reference numerals refer to identical or similar or functionally identical components.

BRIEF DESCRIPTION OF THE DRAWINGS

In each case schematically.

DETAILED DESCRIPTION

Figure 1:
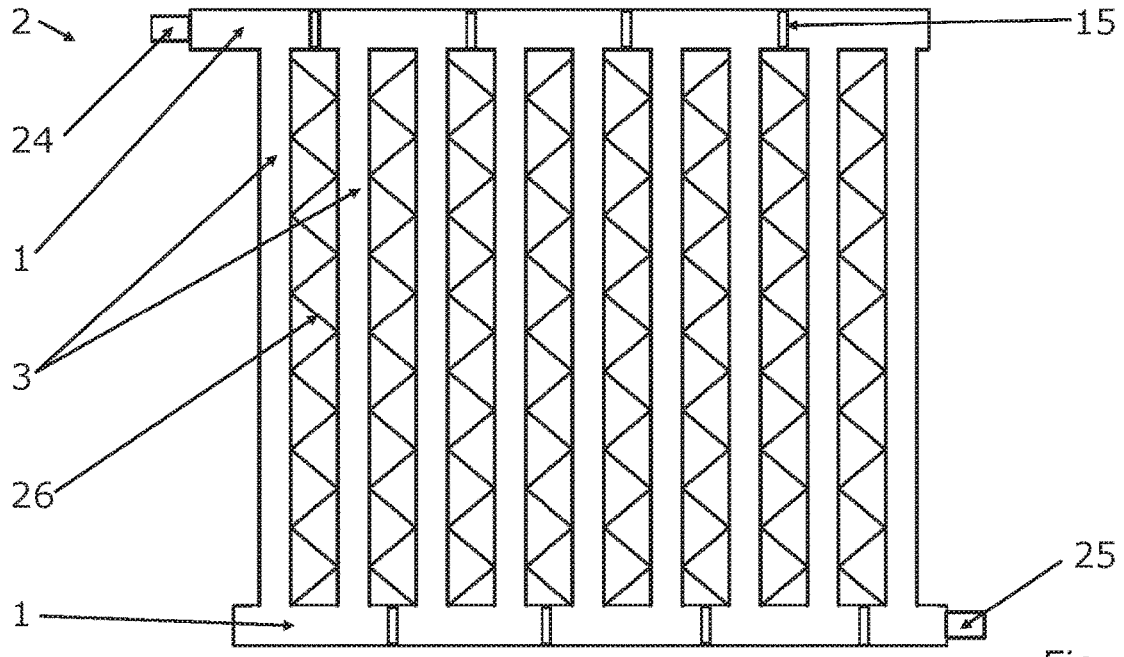
FIG. 1 shows a heat exchanger or condenser, respectively.

As illustrated in FIG. 1, the heat exchanger 2 has a plurality of flat tubes 3, which are fluidically connected to two collector tubes 1. The collector tubes 1 and the flat tubes 3 are arranged essentially transversely to one another. A first collector tube 1 is provided with an inlet 24, and a second collector tube 1 has an outlet 25. The inlet 24 and the outlet 25 can be connected to a non-illustrated air conditioning circuit of a vehicle, wherein the air conditioning circuit can be used to regulate the room temperature in the vehicle interior.

If the heat exchanger 2 is used as condenser, a refrigerant of the air conditioning circuit enters in the vaporous aggregate state into the collector tube 1 through the inlet 24 and flows through the flat tubes 3. Separating elements 15 are inserted in the collector tubes 1 in such a way that a meander-shaped flow guidance of the refrigerant results. While the refrigerant flows through the flat tubes 3, it dissipates its heat energy to the flat tubes 3 or to the surrounding area of the flat tubes 3, respectively, so that it cools down and condenses. Fins 26, which increase the mechanical stability of the heat exchanger 2 and which enlarge the surface, via which the heat energy of the refrigerant can be discharged to the external environment, are arranged between the flat tubes 3. The condensed refrigerant is supplied to the air conditioning circuit via the outlet 25.

Figure 2:
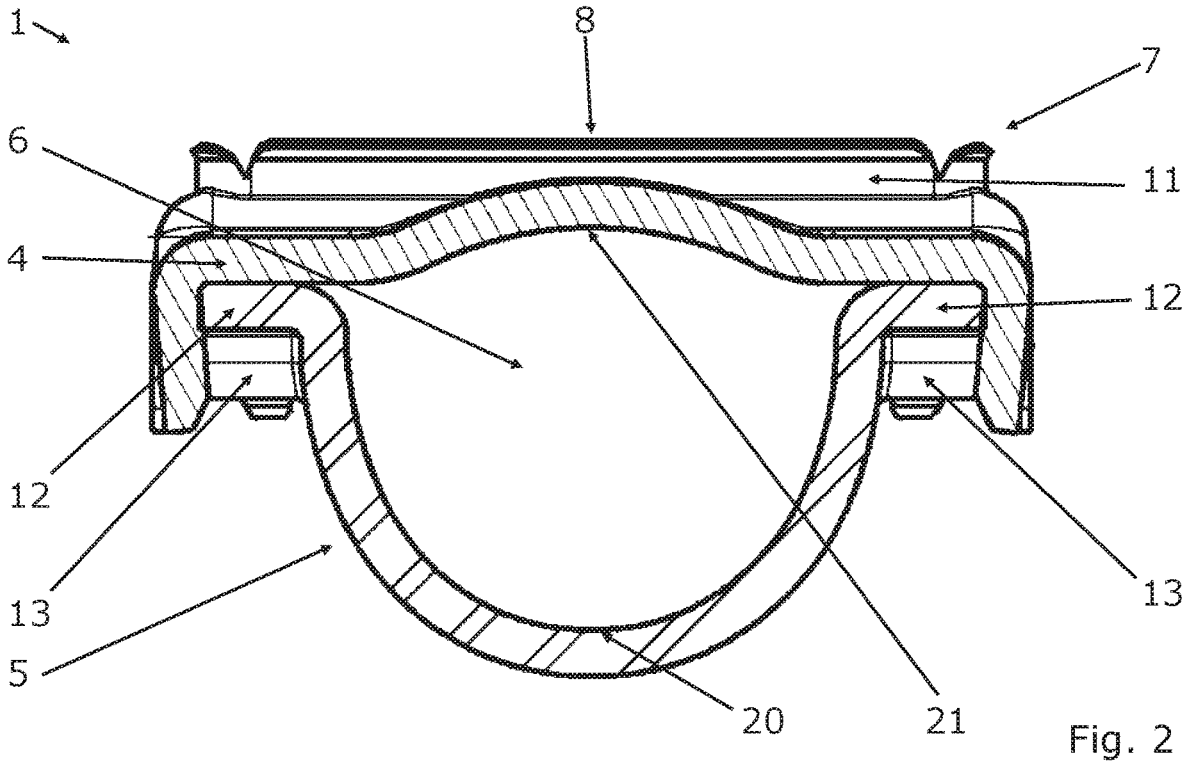
FIG. 2 shows a cross section of a collector tube according to the invention.
Figure 3:
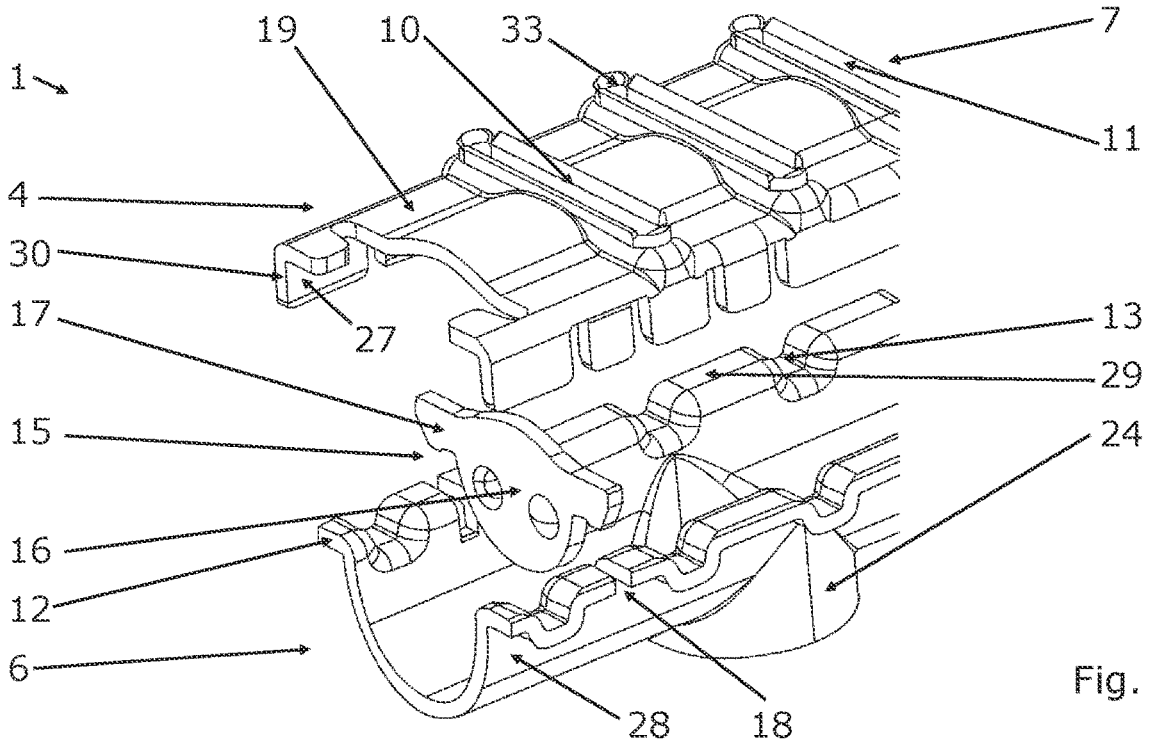
FIG. 3 shows a perspective view of a collector tube according to the invention prior to the assembly.

FIG. 2 shows a cross section of a collector tube according to the invention. A perspective view of this collector tube 1 prior to the assembly is shown in FIG. 3. The collector tube 1 consists of a base 4 and a cover 5, wherein the base 4 has a base collar 30. Compared to the cover 5, the base 4 is embodied to be essentially flat. The base 4 and the cover 5 can be made of a sheet metal, wherein the collector tubes 1 as well as the entire heat exchanger 2 can be produced by means of soldering.

The base 4 has an outer base surface 19 and an inner base surface 27. The outer base surface 19 is defined as the surface of the base 4, which is in contact with the external environment in the case of the assembled collector tube 1. A protective layer 34 may be disposed on at least a portion of the outer base surface 19 (see, e.g., FIG. 6). The remaining surface of the base 4, which is not in contact with the external environment in the case of the assembled collector tube 1, is defined as inner base surface 27.

The cover 5 has an outer cover surface 28 and an inner cover surface 29. The outer cover surface 28 is defined as the surface of the cover 5, which is in contact with the external environment in the case of the assembled collector tube 1. The remaining surface of the cover 5, which is not in contact with the external environment in the case of the assembled collector tube 1, is defined as inner cover surface 29.

A subarea of the inner base surface 27 bears on a subarea of the inner cover surface 29, wherein this subarea of the inner base surface 29 is essentially formed by the base collar 12. A further subarea of the inner base surface 27 is embodied as base area 21 and is spaced apart from a further subarea of the inner cover surface 29, wherein this subarea of the inner cover surface 29 embodies an arch area 20. The base area 21 and the arch area 20 limit a longitudinal duct 6, through which a refrigerant can flow.

The base area 21 has a curvature, which extends away from the cover 5. This curvature improves the pressure stability of the collector tube 1. The arch area 20 also has a curvature, which extends away from the base 4. Due to the fact that the curvature radius of the arch area 20 is smaller than the curvature radius of the base area 21, the arch area 20 limits a larger cross sectional surface of the longitudinal duct 6 than the base area 21.

The base 4 has a plurality of passages 7, which are arranged spaced apart from one another along the longitudinal extension of the longitudinal duct 6. Each passage 7 has an opening 8 and a collar 11, which extends away from the longitudinal duct 6. The opening 8 has a wide edge 10 and a narrow edge 33, which correspond to the dimensions of the flat tubes 3 in such a way that the flat tubes 3 can be inserted through the respective opening 8. It can be seen particularly well in FIG. 6 that the opening 8 of the passage 7 can initially taper towards the longitudinal duct 6 and can subsequently widen again. The insertion of the respective flat tube 3 into the respective passage 7 can be simplified thereby.

In areas opposite a passage 7, the cover collar 12 has depressions 13. Each of these depressions 13 can be embossed in the cover collar 12 and, together with the inner base surface 27 of the base 4, in each case embodies a transverse duct, the diameter of which can correspond to at least the length of the narrow edge 33 of the opening 8. The transverse ducts guide the refrigerant, which flows through the edge areas of the respective flat tube 3, to the longitudinal duct. A fluidically more advantageous transition from the flat tube 3 to the longitudinal duct 6 is thus provided. It is a further advantage that the front edges of the flat tubes do not bear on the cover collar 12 and are thus not damaged.

Figure 5:
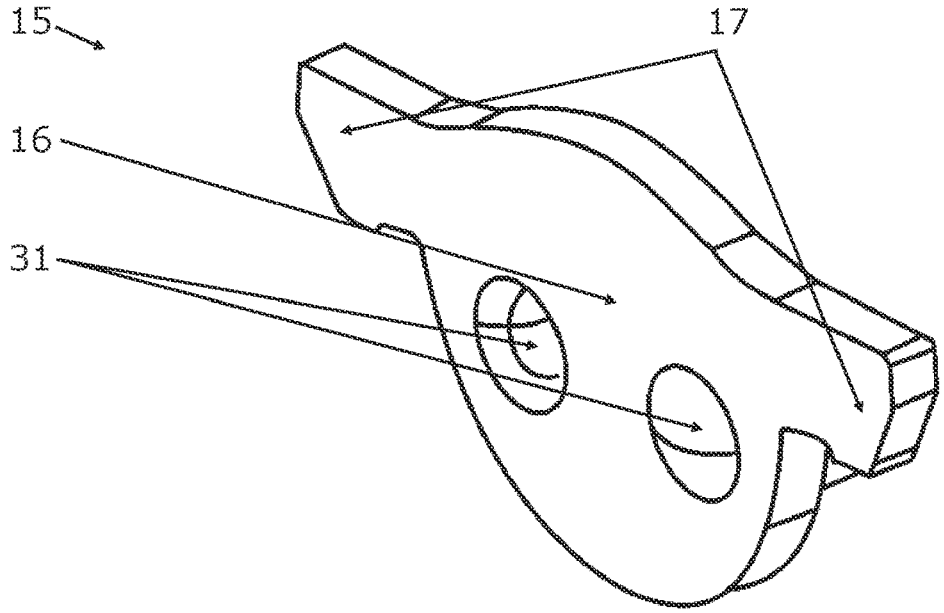
FIG. 5 shows a perspective view of a separating element according to the invention.

A separating element 15 is illustrated in FIG. 3 prior to the assembly of the collector tube 1. This separating element 15 is shown in the enlarged illustration in FIG. 5. The separating element 15 has a separating wall 16, the contour of which corresponds to the cross sectional contour of the longitudinal duct 6, so as to provide for a fluid-tight segmenting of the longitudinal duct 6. The separating element 15 has two holder arms 17, between which the separating wall 16 is arranged. The separating wall 16 can be provided with elevations 31, wherein the elevations 31 can be curved in opposite directions.

The cover 5 and the cover collar 12 have recesses 18, which correspond to the dimensions of the holder arms 17. The separating element 15 is inserted into these recesses 18, which can be embodied as slits, prior to the assembly of the base 4 and of the cover 5. The separating element 15 is thus located in the cover 5 in an initially non-tiltable and captive manner, and subsequently in the collector tube 1 in a non-tiltable and captive manner.

Figure 4:
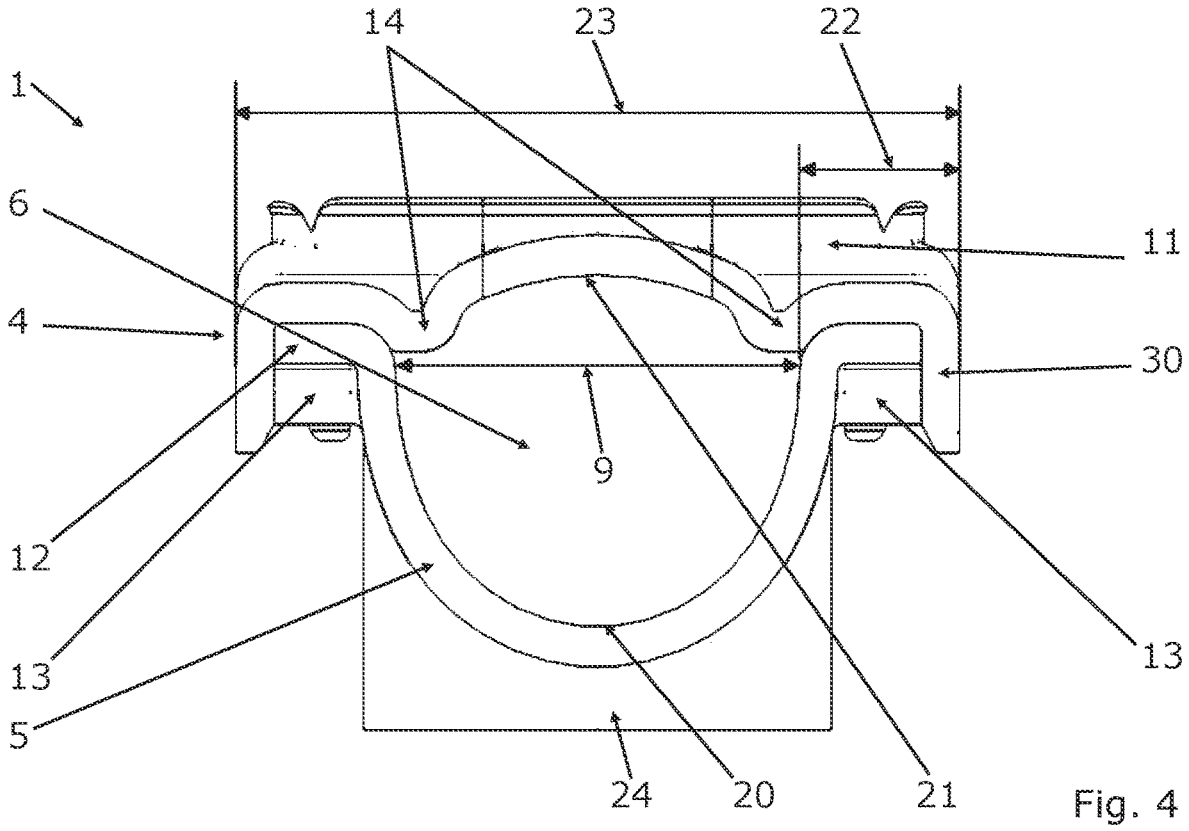
FIG. 4 shows a cross section of a collector tube according to the invention comprising a reinforcing bead.

FIG. 4 shows a cross section of a collector tube 1 according to the invention, wherein, compared to the collector tube 1 of FIG. 1, the collector tube 1 is provided with at least one reinforcing bead 14. This reinforcing bead 14 can be embossed in the base 4 between two passages 7 and can have a longitudinal extension, which can be essentially parallel to the longitudinal extension of the longitudinal duct 6. The reinforcing beads 14 can have a curvature radius, which is smaller than the curvature radius of the base area 21.

The reinforcing beads 14 are arranged between the base area 21 and the area, in which the inner base surface 27 and the inner cover surface 29 touch. The reinforcing beads lead to a reduction of the peel stress, because the respective reinforcing bead 14 clings to the transition radius between arch area 20 and cover collar 12 in such a way that the peel stress is at least partially converted into a shear stress.

The relevant dimensions for the optimal dimensioning of the collector tube 1 are also illustrated in FIG. 4. The diameter 9 of the longitudinal duct 6 is smaller than the length of the wide edge 10 of the opening 8. The length 22 is the sum of the cover collar width and the material thickness of the base collar 30. The base width 23 corresponds to the sum of the diameter 9 and twice the length 22.

Figure 6:
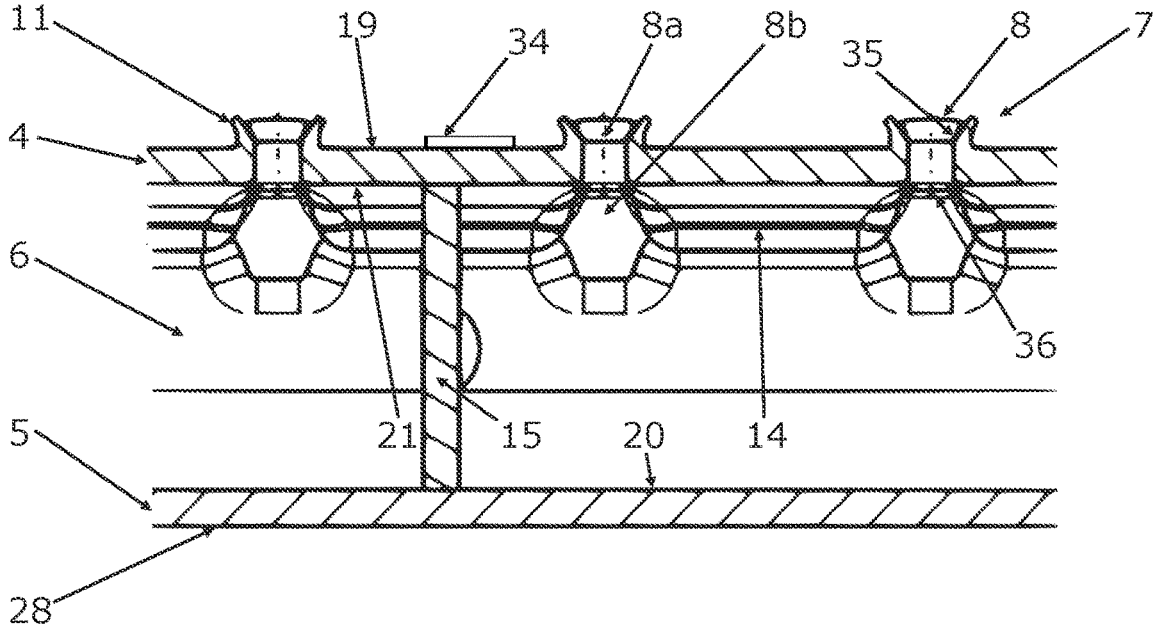
FIG. 6 shows a longitudinal section along a collector tube according to the invention.

A longitudinal section along a collector tube 1 according to the invention comprising a reinforcing bead 14 is shown in FIG. 6, in which it can be seen well that a first subarea 8*a* of the opening 8 of the at least one passage 7 tapers at least partially towards the longitudinal duct 6, wherein a second subarea 8*b* of the opening 8 is provided between the first subarea 8*a* of the opening 8 and the longitudinal duct 6, which widens towards the longitudinal duct 6. The opening 8 of the at least one passage 7 thus embodies an insertion bevel 35 above an outer base surface 19 and a widening 36 below the outer base surface 19. Above can be understood such that the insertion bevel 35 extends away from the outer base surface 19 and the longitudinal duct 6, thus is not arranged between outer base surface 19 and longitudinal duct 6. Below can be understood such that the widening 36 extends from the outer base surface 19 to the longitudinal duct 6 or is arranged between outer base surface 19 and longitudinal duct 6, respectively.

The invention claimed is:

1. A collector tube for a heat exchanger having at least one flat tube, comprising:
- a base and a cover;
- the cover arranged opposite the base;
- the base and the cover defining a longitudinal duct;
- the base including at least one passage having an opening configured to accommodate the at least one flat tube of the heat exchanger;
- the opening having at least one wide edge and at least one narrow edge;
- the longitudinal duct having, in a cross section, a diameter that is smaller than the at least one wide edge of the opening;
- wherein the at least one passage includes a collar extending away from the longitudinal duct;
- wherein the base has an outer base surface; and
- wherein a protective layer is disposed on at least a portion of the outer base surface.

2. The collector tube according to claim 1, wherein a first subarea of the opening tapers at least partially towards the longitudinal duct.

3. The collector tube according to claim 2, wherein a second subarea of the opening widens towards the longitudinal duct, the second subarea of the opening disposed between the first subarea of the opening and the longitudinal duct.

4. The collector tube according to claim 3, wherein the opening includes an insertion bevel disposed above an outer base surface and a widening disposed below the outer base surface.

5. The collector tube according to claim 1, wherein:
- the cover includes at least one cover collar; and
- in areas disposed opposite the at least one passage, the at least one cover collar includes at least one depression extending away from the longitudinal duct.

6. The collector tube according to claim 1, wherein:
- the at least one passage includes at least two passages disposed spaced apart from one another; and
- at least one reinforcing bead is disposed in the base between the at least two passages.

7. The collector tube according to claim 5, wherein:
- at least one separating element is disposed between the cover and the base;
- the at least one separating element includes at least one separating wall and at least one holding arm; and
- the cover includes at least one recess into which the at least one holding arm is insertable.

8. The collector tube according to claim 1, wherein:
- the longitudinal duct has a semi-circular cross section including an arch area and a base area;
- the arch area is formed by the cover;
- a cover collar having a cover collar width is connected to each side of the arch area;
- the base area is formed by the base;
- the base includes a base collar having a predetermined material thickness; and a sum L of the cover collar width and the material thickness of the base collar with a predetermined base width B of the base is between $$L_1 = \frac{(B - 11\text{ mm})}{2} - 1\text{ mm and } L_2 = \frac{(B - 11\text{ mm})}{2} + 1\text{ mm.}$$

9. The collector tube according to claim 8, wherein the cover collar connected to a first side of the arch area and the cover collar connected to a second side of the arch area have different cover collar widths and different sums $L_A$ and $L_B$, and wherein an average $(L_A+L_B)/2$ is between $L_1$ and $L_2$.

10. A heat exchanger, for a vehicle, comprising:

a plurality of flat tubes disposed spaced apart from one another;

the plurality of flat tubes fluidically connected to one another via at least one collector tube, the at least one collector tube including:

a base and a cover;

the cover arranged opposite the base;

the base and the cover defining a longitudinal duct;

the base including at least one passage having an opening configured to accommodate the at least one flat tube of the heat exchanger;

the opening having at least one wide edge and at least one narrow edge;

the longitudinal duct having, in a cross section, a diameter that is smaller than the at least one wide edge of the opening;

wherein the at least one passage includes a collar extending away from the longitudinal duct;

wherein the longitudinal duct has a semi-circular cross section including an arch area and a base area;

wherein the arch area is formed by the cover;

wherein a cover collar having a cover collar width is connected to each side of the arch area;

wherein the base area is formed by the base;

wherein the base includes a base collar having a predetermined material thickness; and wherein a sum L of the cover collar width and the material thickness of the base collar with a predetermined base width B of the base is between $$L_1 = \frac{(B - 11\text{ mm})}{2} - 1\text{ mm and } L_2 = \frac{(B - 11\text{ mm})}{2} + 1\text{ mm.}$$

11. The heat exchanger according to claim 10, wherein:

the base is structured flat;

the plurality of flat tubes are arranged in the at least one passage of the at least one collector tube; and a plurality of front edges of the plurality of flat tubes are flush with the base.

12. The collector tube according to claim 1, wherein:

the cover has an inner cover surface facing toward the base, the inner cover surface including at least one contact subarea and at least one arch subarea;

the at least one contact subarea contacts an inner base surface of the base facing the cover; and the at least one arch subarea is disposed spaced apart from the base and at least partially delimits the longitudinal duct.

13. The collector tube according to claim 12, wherein:

the at least one contact subarea includes at least two contact subareas, the at least one arch subarea extending between and connecting the at least two contact subareas; and the diameter of the longitudinal duct is defined by the distance between the at least two contact subareas.

14. The collector tube according to claim 13, wherein:

the base has an inner base surface facing toward the cover, the inner base surface including a base subarea disposed spaced apart from the at least one arch subarea and at least partially delimiting the longitudinal duct;

a portion of the cover defining the at least one arch subarea is curved away from the base; and a portion of the base defining the base subarea is curved at least one of away from and toward the cover.

15. The collector tube according to claim 14, wherein the base subarea has at least one curvature radius that is larger than a smallest curvature radius of the at least one arch subarea.

16. The collector tube according to claim 1, wherein a difference between the diameter of the longitudinal duct and a length of the at least one wide edge of the opening is larger than twice a material thickness of at least one of the base and the cover.

17. The collector tube according to claim 1, wherein:

the cover includes at least one cover collar via which the cover contacts the base;

the at least one cover collar including at least one embossed depression; and the portion of the at least one cover collar including the at least one depression and the base define a transverse duct extending transversely to the longitudinal duct.

18. A collector tube for a heat exchanger having at least one flat tube, comprising:

a base and a cover arranged opposite the base such that the base and the cover define a longitudinal duct;

a separating element arranged between the base and the cover, the separating element having a contour corresponding to a cross sectional contour of the longitudinal duct such that the separating element divides the longitudinal duct into fluid-tight segments;

the base including at least one passage having an opening configured to accommodate the at least one flat tube of the heat exchanger, the opening having at least one wide edge and at least one narrow edge;

a cross section of the longitudinal duct having a diameter that is smaller than a length of the at least one wide edge of the opening; and wherein the base includes a collar surrounding the opening and protruding from the base away from the longitudinal duct.

19. The collector tube according to claim 18, wherein:

a separating wall of the separating element includes a plurality of elevations; and at least one elevation of the plurality of elevations is curved in an opposite direction than at least one other elevation of the plurality of elevations.

20. The collector tube according to claim 1, further comprising at least one separating element including at least one separating wall and two holding arms projecting from the at least one separating wall in opposite directions, wherein:

the cover includes two recess disposed on opposite sides of the longitudinal duct; and the at least one separating element is disposed between the cover and the base, and the two holding arms are disposed within the two recesses of the cover.

* * * * *